US009842594B2

(12) United States Patent
Ekstrand et al.

(10) Patent No.: US 9,842,594 B2
(45) Date of Patent: Dec. 12, 2017

(54) FREQUENCY BAND TABLE DESIGN FOR HIGH FREQUENCY RECONSTRUCTION ALGORITHMS

(71) Applicant: DOLBY INTERNATIONAL AB, Amsterdam Zuidoost (NL)

(72) Inventors: Per Ekstrand, Saltsjobaden (SE); Kristofer Kjoerling, Solna (SE)

(73) Assignee: Dolby International AB, Amsterdam Zuidoost (NL)

( * ) Notice: Subject to any disclaimer, the term of this patent is extended or adjusted under 35 U.S.C. 154(b) by 10 days.

(21) Appl. No.: 14/914,524

(22) PCT Filed: Aug. 11, 2014

(86) PCT No.: PCT/EP2014/067168
§ 371 (c)(1),
(2) Date: Feb. 25, 2016

(87) PCT Pub. No.: WO2015/028297
PCT Pub. Date: Mar. 5, 2015

(65) Prior Publication Data

US 2016/0210970 A1 Jul. 21, 2016

Related U.S. Application Data

(60) Provisional application No. 61/871,575, filed on Aug. 29, 2013.

(51) Int. Cl.
*G10L 19/02* (2013.01)
*G10L 19/002* (2013.01)
(Continued)

(52) U.S. Cl.
CPC ..... *G10L 19/002* (2013.01); *G10L 19/0208* (2013.01); *G10L 21/0388* (2013.01); *G10L 19/0204* (2013.01); *G10L 2019/0001* (2013.01)

(58) Field of Classification Search
CPC ..... G10L 21/038; G10L 19/02; G10L 19/008; G10L 19/0208; G10L 19/0204; G10L 2019/0001; G10L 21/0388
See application file for complete search history.

(56) References Cited

U.S. PATENT DOCUMENTS 7,272,566 B2 * 9/2007 Vinton ..... G10L 19/035 704/200.1
7,519,538 B2 * 4/2009 Villemoes ..... G10L 21/038 704/205

(Continued)

OTHER PUBLICATIONS

Information Technology—Coding of Audio-Visual Objects—Part 3: Audio for MPEG4-AAC, ISO/IEC 14496-3 (2005).

(Continued)

*Primary Examiner* — Jialong He

(57) ABSTRACT

The present document relates to audio encoding and decoding. In particular, the present document relates to audio coding schemes which make use of high frequency reconstruction (HFR) methods. A system configured to determine a master scale factor band table of a highband signal (105) of an audio signal is described. The highband signal (105) is to be generated from a lowband signal (101) of the audio signal using a high frequency reconstruction (HFR) scheme. The master scale factor band table is indicative of a frequency resolution of a spectral envelope of the highband signal (105).

29 Claims, 4 Drawing Sheets

Figure 1:
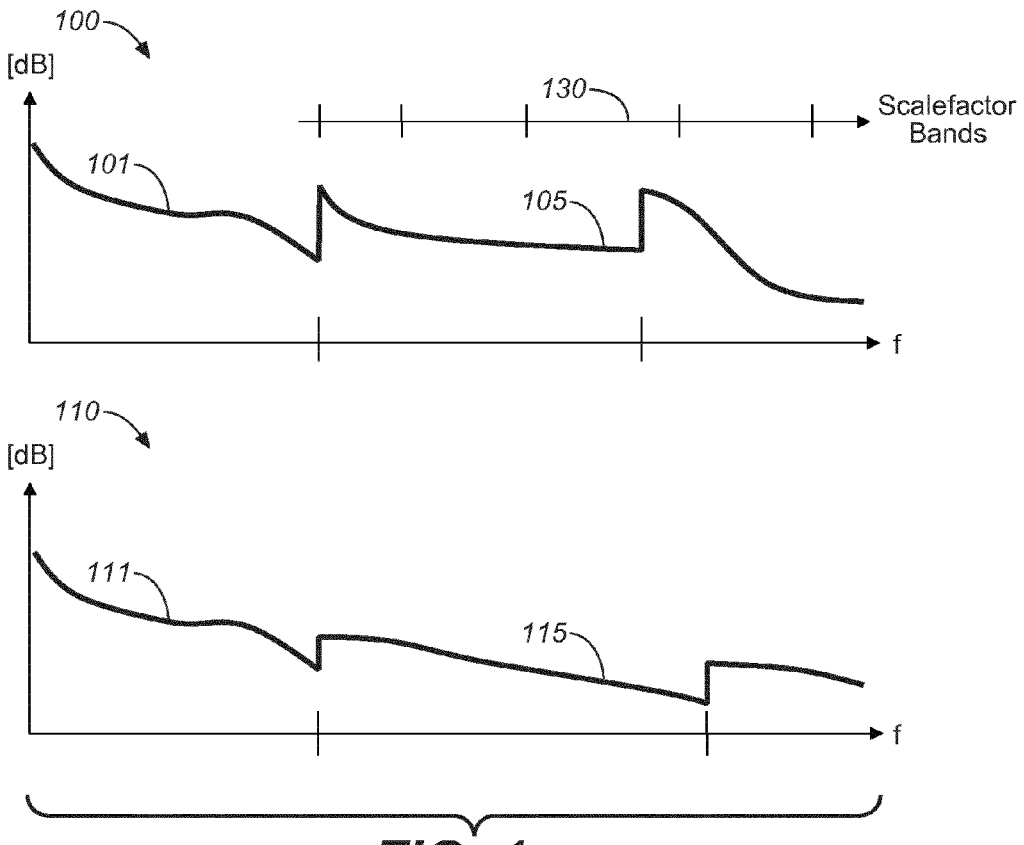

(51) Int. Cl.
*G10L 21/0388* (2013.01)
*G10L 19/00* (2013.01)

(56) References Cited

U.S. PATENT DOCUMENTS 8,140,324 B2 * 3/2012 Vos ..... G10L 19/0208 704/200.1
8,543,385 B2 * 9/2013 Liljeryd ..... G10L 21/038 704/200.1
2001/0027392 A1 10/2001 Wiese
2002/0007280 A1 * 1/2002 McCree ..... G10L 19/0208 704/500
2002/0173951 A1 * 11/2002 Ehara ..... G10L 19/07 704/219
2003/0044028 A1 * 3/2003 Cranfill ..... H03G 3/301 381/107
2005/0004793 A1 * 1/2005 Ojala ..... G10L 21/038 704/219
2005/0096917 A1 * 5/2005 Kjorling ..... G10L 19/24 704/500
2005/0251387 A1 * 11/2005 Jelinek ..... G10L 19/24 704/223
2006/0149538 A1 * 7/2006 Lee ..... G10L 19/0204 704/219
2006/0282262 A1 * 12/2006 Vos ..... G10L 19/0208 704/219
2008/0004869 A1 * 1/2008 Herre ..... G10L 19/22 704/211
2008/0164942 A1 * 7/2008 Takeuchi ..... H03F 1/26 330/149
2008/0208575 A1 * 8/2008 Laaksonen ..... G10L 21/038 704/225
2010/0114583 A1 * 5/2010 Lee ..... G10L 19/025 704/500
2010/0241433 A1 * 9/2010 Herre ..... G10L 19/022 704/500
2012/0275607 A1 11/2012 Kjoerling
2013/0051571 A1 2/2013 Nagel
2013/0226597 A1 * 8/2013 Kjoerling ..... G10L 19/0204 704/500
2014/0200899 A1 * 7/2014 Yamamoto ..... G10L 19/265 704/500
2015/0073784 A1 * 3/2015 Gao ..... G10L 19/12 704/223
2015/0228288 A1 * 8/2015 Subasingha ..... G10L 19/0204 704/500
2016/0203826 A1 * 7/2016 Kaniewska ..... G10L 21/038 704/500

OTHER PUBLICATIONS

MPEG-D USAC: ISO/IEC 23003-3—Unified Speech and Audio Coding, 2012.
Kristofer Kjorling "ISO/IEC 14496-3:2001/FPDAM1, Bandwidth Extension, with the Simple Editorial Changes, listed in NB Comments, Incorporated" MPEG Meeting, Mar. 2003, pp. 1-107.
"Digital Audio Compression (AC-4) Standard" Technical Specification, European Telecommunications Standards Institute (ETSI), vol. Broadcas, No. V1.1.1., Apr. 1, 2014, pp. 1-295.

* cited by examiner

FREQUENCY BAND TABLE DESIGN FOR HIGH FREQUENCY RECONSTRUCTION ALGORITHMS

CROSS-REFERENCE TO RELATED APPLICATIONS

This application claims priority to U.S. Provisional Application No. 61/871,575, filed on 29 Aug. 2013, incorporated herein by reference in its entirety.

TECHNICAL FIELD

The present document relates to audio encoding and decoding. In particular, the present document relates to audio coding schemes which make use of high frequency reconstruction (HFR).

BACKGROUND

HFR technologies, such as the Spectral Band Replication (SBR) technology, allow you to significantly improve the coding efficiency of traditional perceptual audio codecs (referred to as core encoders/decoders). In combination with MPEG-4 Advanced Audio Coding (AAC), HFR forms a very efficient audio codec, which is in use, for example, within the XM Satellite Radio system and Digital Radio Mondiale, and also standardized within 3GPP, DVD Forum and others. One implementation of AAC with SBR is called Dolby Pulse. AAC with SBR is part of the MPEG-4 standard where it is referred to as the High Efficiency AAC Profile (HE-AAC). In general, HFR technology can be combined with any perceptual audio (core) codec in a back and forward compatible way, thus offering the possibility to upgrade already established broadcasting systems like the MPEG Layer-2 used in the Eureka DAB system. HFR methods can also be combined with speech codecs to allow wide band speech at ultra low bit rates.

The basic idea behind HFR is the observation that usually a strong correlation between the characteristics of the high frequency range of a signal and the characteristics of the low frequency range of the same signal is present. Thus, a good approximation for the representation of the original input high frequency range of a signal can be achieved by a signal transposition from the low frequency range to the high frequency range.

High Frequency Reconstruction can be performed in the time-domain or in the frequency domain, using a filter bank or a time domain to frequency domain transform. The process usually involves the step of creating a high frequency signal, and to subsequently shape the high frequency signal to approximate the spectral envelope of the original high frequency spectrum. The step of creating a high frequency signal may, for example, be based on single sideband modulation (SSB) where a sinusoid with frequency $\omega$ is mapped to a sinusoid with frequency $\omega+\Delta\omega$ where $\Delta\omega$ is a fixed frequency shift. In other words, the high frequency signal (also referred to as the highband signal) may be generated from the low frequency signal (also referred to as the lowband signal) by a "copy-up" operation of low frequency subbands (also referred to as lowband subbands) to high frequency subbands (also referred to as highband subbands). A further approach to creating a high frequency signal may involve harmonic transposition of low frequency subbands. Harmonic transposition of order T is typically designed to map a sinusoid of frequency $\omega$ of the low frequency signal to a sinusoid with frequency $T\omega$, with $T>1$, of the high frequency signal.

As indicated above, subsequent to creating a high frequency signal, the shape of the spectral envelope of the high frequency signal is adjusted in accordance to the spectral shape of the high frequency component of the original audio signal. For this purpose, scale factors for a plurality of scale factor bands may be transmitted from the audio encoder to the audio decoder. The present document addresses the technical problem of enabling the audio decoder to determine the scale factor bands (for which scale factors are provided from the audio encoder) in a computationally and bit rate efficient manner.

SUMMARY

According to an aspect a system configured to determine a master scale factor band table for a highband signal of an audio signal is described. The system may be part of an audio encoder and/or a decoder. The master scale factor band table may be used in the context of a high frequency reconstruction, HFR, scheme to generate the highband signal of the audio signal from a lowband signal of the audio signal. The master scale factor band table may be indicative of a frequency resolution of a spectral envelope of the highband signal. In particular, the master scale factor band table may be indicative of a plurality of scale factor bands. The plurality of scale factor bands may be associated with a corresponding plurality of scale factors, wherein the scale factor of a scale factor band is indicative of the energy of the original audio signal within the scale factor band or indicative of the gain factor to be applied to the samples of the scale factor band in order to generate a highband signal with energy approximating the energy of the original audio signal within the scale factor band. As such, the plurality of scale factors and the plurality of scale factor bands provide an approximation of the spectral envelope of the original audio signal within the frequency range covered by the plurality of scale factor bands of the master scale factor band table (or a scale factor band table derived therefrom).

The system may be configured to receive a set of parameters. The set of parameters may comprise one or more parameters (e.g. a start frequency parameter and/or a stop frequency parameter) which represent indexes into a pre-determined scale factor band table. Furthermore, the set of parameters may comprise a selection parameter (e.g. a master scale parameter) which may be used to select a particular one of a plurality of different pre-determined scale factor band tables.

The system may be configured to provide a pre-determined scale factor band table. In particular, the system may be configured to provide a plurality of different pre-determined scale factor band tables (e.g. a high bit rate scale factor band table and a low bit rate scale factor band table). The one or more pre-determined scale factor band tables may be stored in a memory of the system. Alternatively, the one or more pre-determined scale factor band tables may be generated using a pre-determined formula or rule stored within the system (without the need of applying parameters which have been generated and transmitted by an audio encoder). In other words, an audio decoder comprising the system may be configured to provide the one or more pre-determined scale factor band tables in an autarkic manner (independent from a corresponding audio encoder).

Typically, at least one of the scale factor bands of the pre-determined scale factor band table comprises a plurality of frequency bands. The audio signal may be transformed from the time domain into the frequency domain using a time domain to frequency domain transform or filter bank (such as a quadrature mirror filter, QMF, bank). In particular, the audio signal may be transformed into a plurality of subband signals for a corresponding plurality of frequency bands (e.g. 64 frequency bands ranging from band index 0 to band index 63). The frequency bands may be grouped into scale factor bands comprising one, two, three, four or more frequency bands. A number of frequency bands comprised within the scale factor bands of a pre-determined scale factor band table may increase with increasing frequency. In particular, the number of frequency bands per scale factor band may be selected in accordance to psychoacoustic considerations. By way of example, the scale factor bands of a pre-determined scale factor band table may follow a Bark scale.

The system may be configured to determine the master scale factor band table by selecting some or all of the scale factor bands of the pre-determined scale factor band table using the set of parameters. In particular, the master scale factor band table may be determined by truncating the pre-determined scale factor band table using at least one of the parameters from the set of parameters. In other words, the master scale factor band table may comprise a subset or all of the scale factor bands of the pre-determined scale factor band table (in accordance to at least one of the parameters from the set of parameters). As such, the master scale factor band table may exclusively comprise scale factor bands which are comprised within the pre-determined scale factor band table. In other words, the master scale factor band table may comprise only scale factor bands taken from the pre-determined scale factor band table.

By using one or more pre-determined scale factor band tables and a set of parameters to select one or more scale factor bands from one of the one or more pre-determined scale factor band tables, the master scale factor band table (which is used in the context of the HFR scheme) can be determined in a computationally efficient manner. As a result, the cost of an audio decoder may be reduced. Furthermore, the signaling overhead for transmitting the set of parameters from an audio encoder to a corresponding audio decoder may be kept small, thereby providing a bit rate efficient scheme for signaling the master scale factor band table from the audio encoder to the audio decoder. This allows the set of parameters to be included in a periodic manner (e.g. for each audio frame) into the audio bitstream which is transmitted from the audio encoder to the audio decoder, thereby enabling broadcasting and/or splicing applications.

As indicated above, the set of parameters may comprise a start frequency parameter indicative of the scale factor band of the master scale factor band table having the lowest frequency of the scale factor bands of the master scale factor band table. In particular, the start frequency parameter may be indicative of the frequency bin corresponding to the lower bound of the lowest scale factor band (lowest with regards to frequency) of the master scale factor band table. The start frequency parameter may comprise a 3 bit value taking on values e.g. between 0 and 7. The system may be configured to remove zero, one or more scale factor bands at a lower frequency end of the pre-determined scale factor band table for determining the master scale factor band table. In particular, the system may be configured to remove an even number of scale factor bands at the lower frequency end of the pre-determined scale factor band table, wherein the even number is twice the start frequency parameter. As such, the start frequency parameter may be used to truncate the lower frequency end of the pre-determined scale factor band table, in order to determine the master scale factor band table.

Alternatively or in addition, the set of parameters may comprise a stop frequency parameter indicative of the scale factor band of the master scale factor band table having the highest frequency of the scale factor bands of the master scale factor band table. In particular, the stop frequency parameter may be indicative of the frequency bin corresponding to the upper bound of the highest scale factor band (highest with regards to frequency) of the master scale factor band table. The stop frequency parameter may comprise a 2 bit value taking on values e.g. between 0 and 3. The system may be configured to remove zero, one or more scale factor bands at an upper frequency end of the pre-determined scale factor band table for determining the master scale factor band table. In particular, the system may be configured to remove an even number of scale factor bands at the upper frequency end of the pre-determined scale factor band table, wherein the even number is twice the stop frequency parameter. As such, the stop frequency parameter may be used to truncate the upper frequency end of the pre-determined scale factor band table, in order to determine the master scale factor band table.

As indicated above, the system may be configured to provide a plurality of pre-determined scale factor band tables. The plurality of pre-determined scale factor band tables may comprise a low bit rate scale factor band table and a high bit rate scale factor band table. In particular, the system may be configured to provide exactly two pre-determined scale factor band tables, i.e. the low bit rate scale factor band table and the high bit rate scale factor band table. The set of parameters may comprise a master scale parameter indicative of (exactly) one of the plurality of pre-determined scale factor band tables, which is to be used to determine the master scale factor band table. In particular, the master scale parameter may comprise a 1 bit value taking on values e.g. between 0 and 1, e.g. to distinguish between the low bit rate scale factor band table and the high bit rate scale factor band table. The use of a plurality of different pre-determined scale factor band tables may be beneficial in order to adapt the HFR scheme to the bit rate of the encoded audio bitstream.

The low bit rate scale factor band table may comprise one or more scale factor bands at lower frequencies than any of the scale factor bands of the high bit rate scale factor band table. Alternatively or in addition, the high bit rate scale factor band table may comprise one or more scale factor bands at higher frequencies than any of the scale factor bands of the low bit rate scale factor band table. In other words, the low bit rate scale factor band table may comprise one or more scale factor bands ranging from a first low frequency bin to a first high frequency bin. As such, the low bit rate scale factor band table may be bound by the first low frequency bin and the first high frequency bin. In a similar manner, the high bit rate scale factor band table may comprise one or more scale factor bands ranging from a second low frequency bin to a second high frequency bin. As such, the high bit rate scale factor band table may be bound by the second low frequency bin and the second high frequency bin. The first low frequency bin may be at a lower frequency (or may have a lower index) than the second low frequency bin. Alternatively or in addition, the second high frequency bin may be at a higher frequency (or may have a higher index) than the first high frequency bin. Furthermore, a number of scale factor bands comprised within the high bit rate scale factor band table may be higher than a number of scale factor bands comprised within the low bit rate scale factor band table. Hence, the pre-determined scale factor band tables may be designed in accordance to the observation that in case of a relatively low bit rate, the frequency range which is covered by the lowband signal is lower than in case of a relatively high bit rate. Furthermore, the pre-determined scale factor band tables may be designed in accordance to the observation that in case of a relatively high bit rate, an improved trade-off between bit rate and perceptual quality can be achieved by extending the frequency range of the highband signal.

The lowband signal and the highband signal of the audio signal may cover a total of 64 frequency bands (e.g. QMF frequency bands or complex QMF, i.e. CQMF, frequency bands), ranging from band index 0 to band index 63. In other words, the frequency bands may correspond to frequency bands generated by a 64 channel filter bank with band indices ranging from 0 to 63. The low bit rate scale factor band table may comprise some or all of the following: scale factor bands from frequency band 10 up to frequency band 20, each scale factor band comprising a single frequency band; scale factor bands from frequency band 20 up to frequency band 32, each scale factor band comprising two frequency bands; scale factor bands from frequency band 32 up to frequency band 38, each scale factor band comprising three frequency bands; and/or scale factor bands from frequency band 38 up to frequency band 46, each scale factor band comprising four frequency bands. The high bit rate scale factor band table may comprise some or all of the following: scale factor bands from frequency band 18 up to frequency band 24, each scale factor band comprising a single frequency band; scale factor bands from frequency band 24 up to frequency band 44, each scale factor band comprising two frequency bands; and/or scale factor bands from frequency band 44 up to frequency band 62, each scale factor band comprising three frequency bands.

A number of scale factor bands comprised within the pre-determined scale factor band table and/or a number of scale factor bands comprised within the master scale factor band table may be an even number. This may be achieved by using pre-determined scale factor band tables which comprise an even number of scale factor bands and by truncating the pre-determined scale factor band tables by an even number of scale factor bands. The use of an even number of scale factor bands may be beneficial in the context of the HFR process as the use of an even number of scale factor bands ensures that the low resolution frequency band table will be an exact decimation of the high resolution frequency band table.

The system may be configured to determine a high resolution frequency band table and a low resolution frequency band table based on the master scale factor band table. The high resolution frequency band table may be used in conjunction with a relatively low temporal resolution (i.e. frames comprising a relatively high number of samples) and the low resolution frequency band table may be used in conjunction with a relatively high temporal resolution (i.e. frames comprising a relatively low number of samples). In this context, the set of parameters may comprise a cross over band parameter indicative of zero, one or more scale factor bands at a lower frequency end of the master scale factor band table, which are to be excluded from high frequency reconstruction. The cross over band parameter may comprise a 2 or 3 bit value taking on values e.g. between 0 and 3 or 7, to indicate the e.g. 0 up to 3 or 7 scale factor bands at the lower frequency end of the master scale factor band table, which are to be excluded. The system may be configured to determine the high resolution frequency band table and the low resolution frequency band table from the master scale factor band table by excluding the zero, one or more scale factor bands at the lower frequency end of the master scale factor band table, in accordance to the cross over band parameter. In particular, the high resolution frequency band table may correspond to the master scale factor band table without the zero, one or more scale factor bands at the lower frequency end of the master scale factor band table, excluded in accordance to the cross over band parameter. Furthermore, the system may be configured to determine the low resolution frequency band table by decimating the high resolution frequency band table (e.g. by a factor of two). As such, the use of pre-determined scale factor band tables and resulting master scale factor band tables having an even number of scale factor bands may be beneficial for generating the low resolution frequency band table in a computationally efficient manner.

It should be noted that the system may be further configured to determine a noise band table and/or a limiter band table from the master scale factor band table (which may also be used in the context of the HFR scheme. Furthermore, a patching scheme for the transposition used in the HFR scheme may be determined based on the master scale factor band table and/or based on the high and low resolution frequency band tables.

The lowband signal and the highband signal may be segmented into a sequence of frames comprising a pre-determined number of samples of the audio signal. The system may be configured to receive an updated set of parameters for a set of frames from the sequence of frames. The set of frames may comprise a pre-determined number of frames (e.g. one, two or more frames). An updated set of parameters may be received for every set of frames (in a periodic manner). The system may be configured to maintain the master scale factor band table unchanged, if the one or more parameters of the updated set of parameters, which affect the master scale factor band table (e.g. the start frequency parameter, the stop frequency parameter and/or the master scale parameter), remain unchanged. The master scale factor band table may be used for performing the HFR scheme for all frames of the set of frames. On the other hand, the system may be configured to determine an updated master scale factor band table, if the one or more parameters of the updated set of parameters, which affect the master scale factor band table (e.g. the start frequency parameter, the stop frequency parameter and/or the master scale parameter), change. The updated master scale factor band table may be used for performing the HFR scheme for all frames of the audio signal, until a further updated master scale factor band table is determined (subject to the reception of a modified set of parameters). As such, a modification of the master scale factor band may be triggered in an efficient manner, by transmitting one or more modified parameters, which affect the master scale factor band table, i.e. by transmitting e.g. a modified start frequency parameter, a modified stop frequency parameter and/or a modified master scale parameter.

According to a further aspect, a high frequency reconstruction, HFR, unit configured to generate a highband signal of an audio signal from a lowband signal of the audio signal is described. The high frequency reconstruction unit may comprise an analysis filter bank (e.g. a QMF bank) configured to determine one or more lowband subband signals. Furthermore, the HFR unit may comprise a transposition unit configured to transpose the one or more lowband subband signals to a highband frequency range, to yield transposed subband signals (e.g. using a copy-up process). In addition, the HFR unit may comprise the system described above, in order to determine a scale factor band table for the highband signal, wherein the scale factor band table comprises a plurality of scale factor bands covering the highband frequency range. Furthermore, the HFR unit or an audio decoder comprising the HFR unit may comprise an envelope adjustment unit which is configured to receive a plurality of scale factors for the plurality of scale factor bands, respectively. The envelope adjustment unit may be further configured to weight or scale the transposed subband signals by the plurality of scale factors, in accordance to the plurality of scale factor bands, to yield scaled subband signals (also referred to as scaled HFR subband signals). The highband signal may be determined based on the scaled subband signals. For this purpose, the HFR unit or an audio decoder comprising the HFR unit may comprise a synthesis filter bank (e.g. an inverse QMF filter bank) configured to determine the highband signal from the weighted transposed frequency bands. In particular, the synthesis filter bank may be configured to determine a reconstructed audio signal (in the time domain) from the one or more lowband subband signals and from the scaled HFR subband signals.

According to another aspect, an audio decoder configured to determine a reconstructed audio signal from a bitstream is described. The audio decoder may comprise a core decoder (e.g. an AAC decoder) configured to determine a lowband signal of the reconstructed audio signal by decoding parts of the bitstream. Furthermore, the audio decoder comprises a high frequency reconstruction unit configured to determine a highband signal of the reconstructed audio signal. In particular, the above mentioned synthesis filter bank may be used to determine the reconstructed audio signal from lowband subband signals derived from the lowband signal and from scaled subband signals (representing the highband signal).

According to another aspect, an audio encoder configured to determine and to transmit a set of parameters is described. The set of parameters may be transmitted along with a bitstream which is indicative of a lowband signal of an audio signal. The set of parameters may enable a corresponding audio decoder to determine a master scale factor band table by selecting some or all of the scale factor bands from a pre-determined scale factor band table, using the set of parameters. The master scale factor band table may be used in the context of a high frequency reconstruction scheme to generate a highband signal of the audio signal from the lowband signal of the audio signal.

According to a further aspect, a bitstream which is indicative of a lowband signal of an audio signal and of a set of parameters is described. The set of parameters may enable an audio decoder to determine a master scale factor band table by selecting some or all of the scale factor bands from a pre-determined scale factor band table using the set of parameters. The master scale factor band table may be used in the context of a high frequency reconstruction scheme to generate a highband signal of the audio signal from the lowband signal of the audio signal.

According to another aspect, a method for determining a master scale factor band table for a highband signal of an audio signal is described. The highband signal is to be generated from a lowband signal of the audio signal, using a high frequency reconstruction scheme. The master scale factor band table may be indicative of a frequency resolution of a spectral envelope of the highband signal. The method may comprise receiving a set of parameters, and providing a pre-determined scale factor band table. At least one of the scale factor bands of the pre-determined scale factor band table may comprise a plurality of frequency bands. The method may further comprise determining the master scale factor band table (only) by selecting some or all of the scale factor bands of the pre-determined scale factor band table, using the set of parameters. As such, the master scale factor band table may be determined solely based on selection operations, without the need for further calculations. Hence, the master scale factor band table may be determined in a computationally efficient manner.

According to a further aspect, a software program is described. The software program may be adapted for execution on a processor and for performing the method steps outlined in the present document when carried out on the processor.

According to another aspect, a storage medium is described. The storage medium may comprise a software program adapted for execution on a processor and for performing the method steps outlined in the present document when carried out on the processor.

According to a further aspect, a computer program product is described. The computer program may comprise executable instructions for performing the method steps outlined in the present document when executed on a computer.

It should be noted that the methods and systems including its preferred embodiments as outlined in the present patent application may be used stand-alone or in combination with the other methods and systems disclosed in this document. Furthermore, all aspects of the methods and systems outlined in the present patent application may be arbitrarily combined. In particular, the features of the claims may be combined with one another in an arbitrary manner.

SHORT DESCRIPTION OF THE FIGURES

Figure 4:
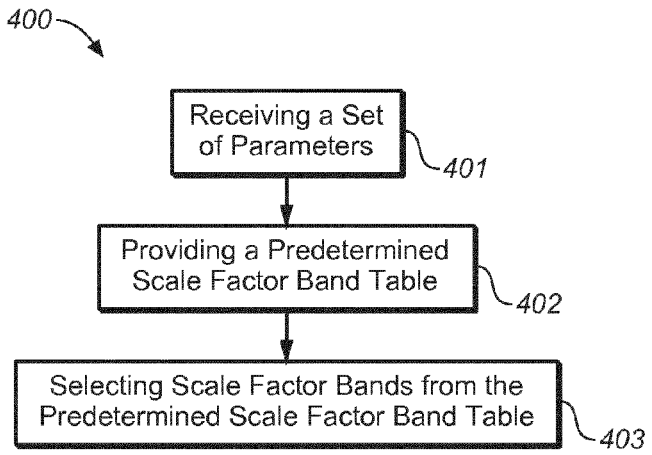
Figure 2:
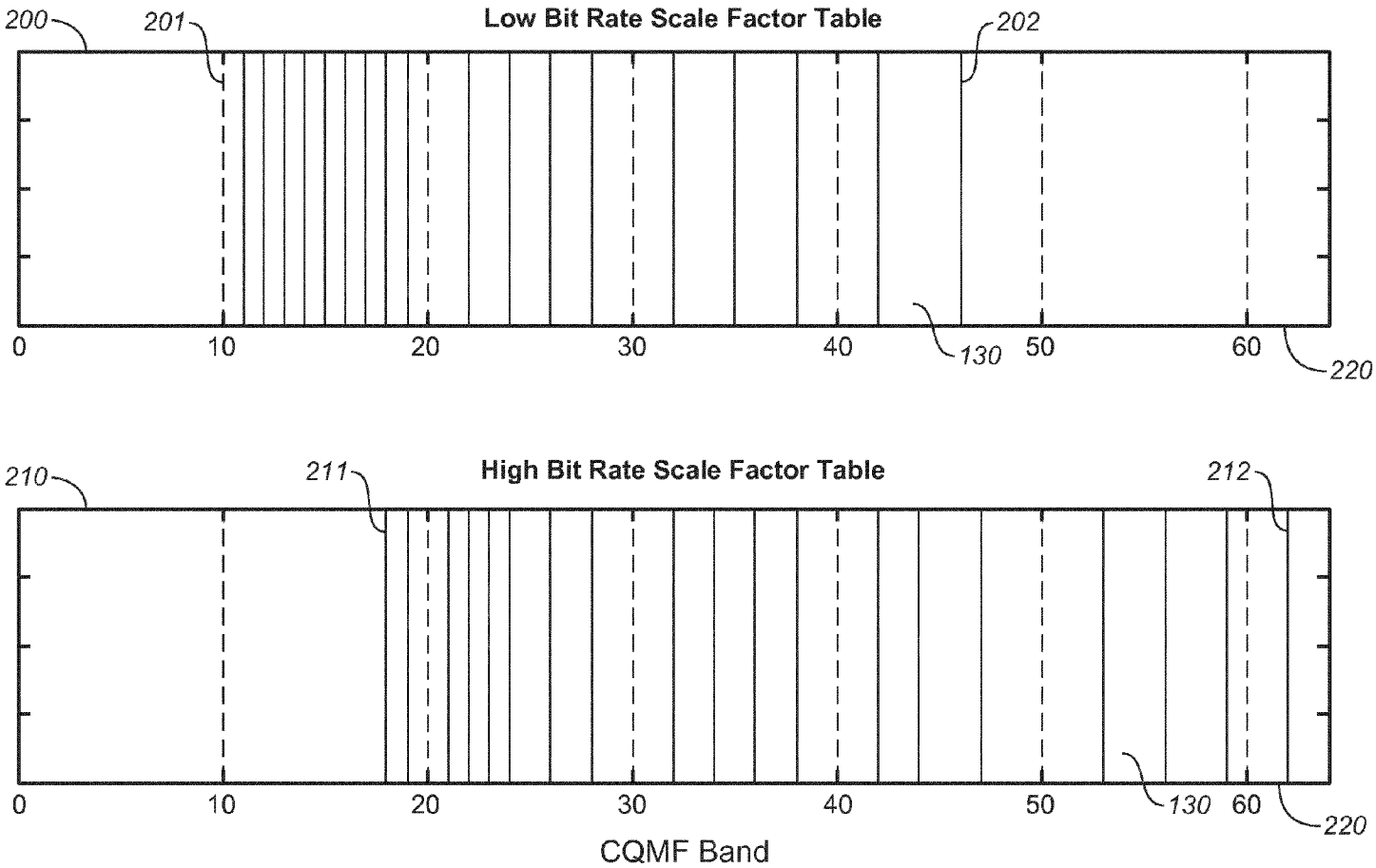
Figure 3A:
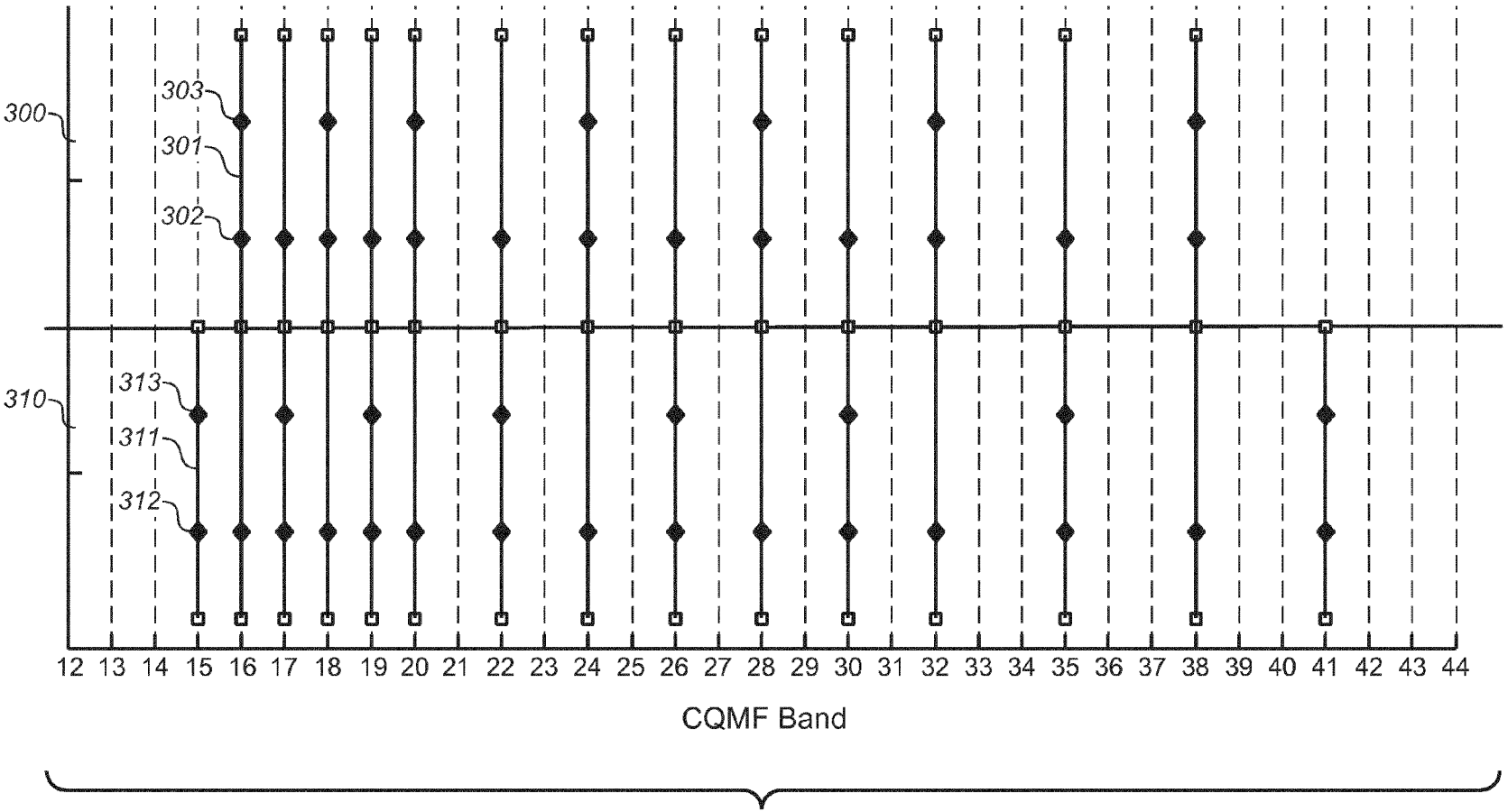
Figure 3B:
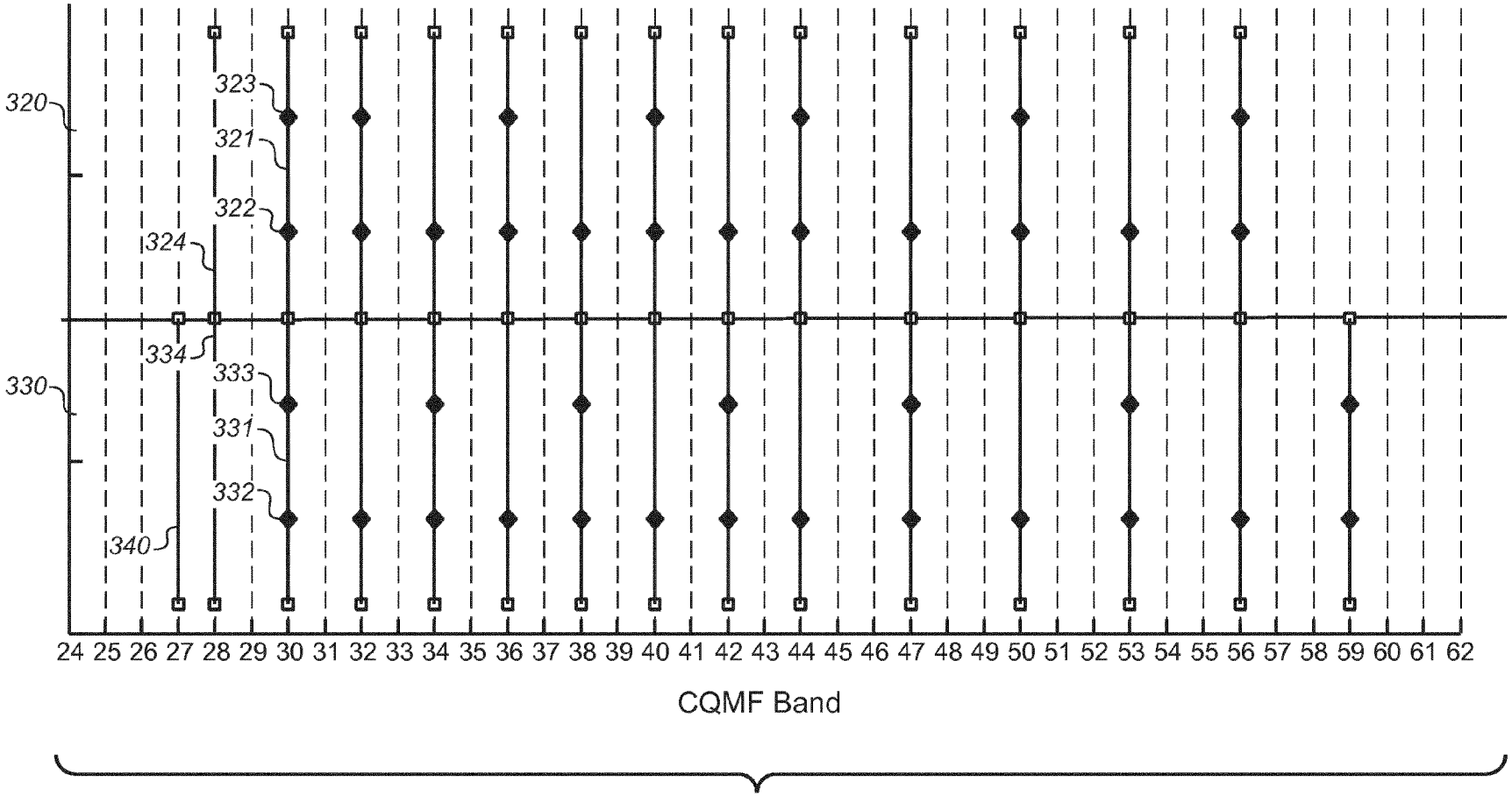

The invention is explained below in an exemplary manner with reference to the accompanying drawings, wherein FIG. 1 shows example lowband and highband signals;

FIG. 2 shows example scale factor band tables;

FIGS. 3*a* and 3*b* show comparisons of example master scale factor band tables; and FIG. 4 shows an example method for generating a highband signal using a pre-determined scale factor band table.

DETAILED DESCRIPTION

Audio decoders which make use of HFR (High Frequency Reconstruction) techniques typically comprise an HFR unit for generating a high frequency audio signal (referred to as a highband signal) from a low frequency audio signal (referred to as a lowband signal) and a subsequent spectral envelope adjustment unit for adjusting the spectral envelope of the high frequency audio signal.

In FIG. 1 a stylistically drawn spectrum 100, 110 of the output of an HFR unit is displayed, prior to going into the envelope adjuster. In the top-panel, a copy-up method (with two patches) is used to generate the highband signal 105 from the lowband signal 101, e.g. the copy-up method used in MPEG-4 SBR (Spectral Band Replication) which is outlined in "ISO/IEC 14496-3 Information Technology—Coding of audio-visual objects—Part 3: Audio" and which is incorporated by reference. The copy-up method translates parts of the lower frequencies 101 to higher frequencies 105. In the lower panel, a harmonic transposition method (with two non-overlapping transposition orders) is used to generate the highband signal 115 from the lowband signal 111, e.g. the harmonic transposition method of MPEG-D USAC which is described in "MPEG-D USAC: ISO/IEC 23003-3—Unified Speech and Audio Coding" and which is incorporated by reference. In the subsequent envelope adjustment stage, a target spectral envelope is applied onto the high frequency components 105, 115.

In addition to the spectrum 100, 110, FIG. 1 illustrates example frequency bands 130 of the spectral envelope data representing the target spectral envelope. These frequency bands 130 are referred to as scale factor bands or target intervals. Typically, a target energy value, i.e. a scale factor energy (or scale factor), is specified for each target interval, i.e. for each scale factor band. In other words, the scale factor bands define the effective frequency resolution of the target spectral envelope, as there is typically only a single target energy value per target interval. Using the scale factors or target energies specified for the scale factor bands, a subsequent envelope adjuster strives to adjust the highband signal so that the energy of the highband signal within the scale factor bands equals the energy of the received spectral envelope data, i.e. the target energy, for the respective scale factor bands.

The present document is directed at an efficient scheme for determining the frequency band tables (which are indicative of the scale factor bands 130 to be used within the HFR or SBR process) at an audio decoder. Furthermore, the present document is directed at reducing the signalling overhead for communicating the frequency band tables (referred to as scale factor band tables) from an audio encoder to the corresponding audio decoder. In addition, the present document is directed at simplifying the tuning of the audio encoder.

A possible approach to determining the frequency band tables (in particular the master scale factor band table) at an audio decoder is based on pre-defined algorithms that make use of parameters which have been transmitted to the audio decoder. During run-time the pre-determined algorithms are executed to calculate the frequency band tables based on the transmitted parameters. The pre-determined algorithms provide a so called "master table" (also referred to as the master scale factor band table). The calculated "master table" may then be used to derive a set of tables needed to correctly decode and apply the parametric data corresponding to the High Frequency Reconstruction algorithm (e.g. the high resolution frequency band table, the low resolution frequency band table, the noise band table and/or a limiter band table).

The above mentioned scheme for determining frequency band tables is disadvantageous, as it requires the transmission of parameters which are used by the audio decoder to calculate the "master tables". Furthermore, the execution of the pre-determined algorithms for calculating the "master tables" requires computing resources at the audio decoder and therefore increases the cost of the audio decoder.

In the present document, it is proposed to make use of one or more pre-determined, static, scale factor band tables. In particular, it is proposed to define two static scale factor band tables, a first table for low bit rates and a second table for high bit rates. The other tables, including the master table, which may be needed by the audio decoder to reconstruct the highband signal 105 may then be derived from the statically pre-defined tables. The derivation of the other tables (in particular the master scale factor band table) may be done in an efficient manner by indexing the pre-defined scale factor band tables with parameters transmitted from the audio encoder to the audio decoder within the data stream (also referred to as bitstream).

The first and second static scale factor band tables may be defined in Matlab notation as

- a first table: sfbTableLow=[(10:20)';(22:2:32)';(35:3:38)';(42:4:46)']; and
- a second table: sfbTableHigh=[(18:24)';(26:2:44)';(47:3:62)'];

providing the scale factor band divisions 210 and 200, respectively, as shown in FIG. 2 (solid lines). In the above mentioned Matlab notation, the numbers indicate individual frequency bands 220 (e.g. quadrature mirror filter bank, QMF, bands or complex-valued QMF, CQMF, bands). The first table (i.e. the low bit rate scale factor band table) starts at frequency band 10 (reference numeral 201) and goes up to frequency band 46 (reference numeral 202). The second table (i.e. the high bit rate scale factor band table) starts at frequency band 18 (reference numeral 211) and goes up to frequency band 62 (reference numeral 212). As such, the first table (for relatively low bit rates, e.g. lower than a pre-determined bit rate threshold) comprises

- scale factor bands 130 from frequency band 10 to 20, which comprise a single frequency band 220 each,
- scale factor bands 130 from frequency band 20 to 32, which comprise two frequency bands 220 each,
- scale factor bands from frequency band 32 to 38, which comprise three frequency bands 220 each, and
- scale factor bands 130 from frequency band 38 to 46, which comprise four frequency bands 220 each.

In a similar manner, the second table (for relatively high bit rates, e.g. higher than the pre-determined bit rate threshold) comprises

- scale factor bands 130 from frequency band 18 to 24, which comprise a single frequency band 220 each,
- scale factor bands 130 from frequency band 24 to 44, which comprise two frequency bands 220 each, and
- scale factor bands 130 from frequency band 44 to 62, which comprise three frequency bands 220 each.

As can be seen from FIG. 2, the low bit rate scale factor band table 200 starts at CQMF band 10 and goes to band 46, having up to 20 scale factor bands 130. The high bit rate scale factor band table 210 supports up to 22 scale factor bands 130 ranging from band 18 to band 62.

In order to derive the master table which is to be used for the decoding of a current frame from the static scale factor band tables 200, 210, three parameters may be used. These parameters may be transmitted from the audio encoder to the audio decoder, in order to enable the audio decoder to derive the master table for the current frame (i.e. in order to derive the current master table). These parameters are:

1. Start frequency (startFreq) parameter: The start frequency parameter may have a length of 3 bits and may take on values between 0 and 7. The start frequency parameter may be an index into the pre-determined scale factor band tables 200, 210 starting from the lowest frequency bands 201, 211 of the respective scale factor band tables 200, 210 (i.e. frequency band 10 or 18) moving upwards in steps of two scale factor bands 130. The parameter value startFreq=1 will hence point to frequency band 20 for the high bit rate scale factor band table 210.
2. Stop frequency (stopFreq) parameter: The stop frequency parameter may have a length of 2 bits and may take on values between 0 and 4. The stop frequency parameter may be an index into the scale factor band tables 200, 210 starting from the highest frequency band (46 or 62) going downwards in steps of two scale factor bands 130. The parameter value stopFreq=2 will hence point to band 50 in the high bit rate scale factor band table 210.

3. Master scale (masterScale) parameter. The master scale parameter may have a length of 1 bit and may take on value between 0 and 1. The master scale parameter may indicate which of the two pre-determined scale factor band tables 200, 210 is currently being used. By way of example, the parameter value masterScale=0 may indicate the low bit rate scale factor band table 200 and the parameter value masterScale=1 may indicate the high bit rate scale factor band table 210.

The following tables 1 and 2 list the possible start and stop frequencies bands for the low bit rate scale factor band table 200 and for the high bit rate scale factor band table 210, respectively, using a sampling frequency of 48000 Hz.

| startFreq | CQMF band | Frequency [Hz] | stopFreq | CQMF band | Frequency [Hz] |
|---|---|---|---|---|---|
| 0 | 10 | 3750 | 0 | 46 | 17250 |
| 1 | 12 | 4500 | 1 | 38 | 14250 |
| 2 | 14 | 5250 | 2 | 32 | 12000 |
| 3 | 16 | 6000 | 3 | 28 | 10500 |
| 4 | 18 | 6750 | | | |
| 5 | 20 | 7500 | | | |
| 6 | 24 | 9000 | | | |
| 7 | 28 | 10500 | | | |

Table 1

Showing Start and Stop Frequencies for the Low Bitrate Scale Factor Band Table

| startFreq | CQMF band | Frequency [Hz] | stopFreq | CQMF band | Frequency [Hz] |
|---|---|---|---|---|---|
| 0 | 18 | 6750 | 0 | 62 | 23250 |
| 1 | 20 | 7500 | 1 | 56 | 21000 |
| 2 | 22 | 8250 | 2 | 50 | 18750 |
| 3 | 24 | 9000 | 3 | 44 | 16500 |
| 4 | 28 | 10500 | | | |
| 5 | 32 | 12000 | | | |
| 6 | 36 | 13500 | | | |
| 7 | 40 | 15000 | | | |

Table 2

Showing Start and Stop Frequencies for the High Bitrate Scale Factor Band Table

Using the master scale parameter, the encoder may indicate to the decoder, which one of the pre-determined scale factor band tables 200, 210 is to be used to derive the master scale factor band table. Using the start frequency parameter and the stop frequency parameter, as outlined in the Tables 1 and 2, the actual master scale factor band table may be determined. By way of example, for masterScale=0, startFreq=1 and stopFreq=2, the master scale factor band table comprises the scale factor bands from the low bit rate scale factor band table 200 ranging from frequency band 12 up to frequency band 32.

The master scale factor band table may correspond to a high resolution frequency band table which is used to perform HFR for continuous segments of an audio signal. A low resolution frequency band table may be derived from the master scale factor band table by decimating the high resolution frequency band table, e.g. by a factor of 2. The low resolution frequency band table may be used for transient segments of the audio signal (in order to allow for an increased temporal resolution, at the expense of a reduced frequency resolution). It can be seen from Tables 1 and 2 that the number of scale factor bands 130 for the high resolution frequency band tables 210, 210 may be an even number. Hence, a low resolution frequency band table may be a perfect decimation of the high resolution table by a factor 2. Moreover, as seen from Tables 1 and 2, the frequency band tables always start and end on an even numbered CQMF band 220.

A fourth parameter that affects the currently used frequency band tables may be the cross over band (xOverBand) parameter. The cross over band parameter may have a length of 2 or 3 bits and may take on values between 0 and 3 (7). The xOverBand parameter may be an index into the high resolution frequency band table (or into the master scale factor band table) starting at the first bin, moving upward with a step of one scale factor band 130. Hence, usage of the xOverBand parameter will effectively truncate the beginning of the high resolution frequency band table and/or the master scale factor band table. The xOverBand parameter may be used to extend the frequency range of the lowband signal 101 and/or to reduce the frequency range of the highband signal 105. Since the xOverBand parameter changes the HFR bandwidth by truncating the existing tables, and in particular without changing the transposer patching scheme, the xOverBand parameter may be used to alter the bandwidth on runtime without audible artifacts, or to allow for different HFR bandwidths in a multi-channel setup, while all channels still use the same patching scheme. For some choices of the xOverBand parameter, the first scale factor band of the high and low resolution frequency band table will be identical (as can be seen e.g. in FIG. 3*b*).

FIGS. 3*a* and 3*b* show a comparison of master scale factor band tables which have been derived based on the pre-determined scale factor band tables 200, 210 and master scale factor band tables which have been derived using an algorithmic approach. FIG. 3*a* shows a situation of a relatively low bit rate of 22 kbps (mono/parametric stereo). The upper half 300 of the diagram shows the master scale factor band table which has been derived using the static low bit rate scale factor band table 200 and the lower half 310 of the diagram shows the master scale factor band table which has been derived using an algorithmic approach. The lines 301, 311 represent the borders of the scale factor bands of the respective master scale factor band tables. The lower diamonds 302, 312 represent the borders of the high resolution scale factor bands and the higher diamonds 303, 313 represent the borders of the low resolution scale factor bands. It can be seen that the master scale factor band tables which are derived using the static, pre-determined scale factor band tables 200, 210 are substantially the same as the master scale factor band tables which are derived using the algorithmic approach.

FIG. 3*b* shows a relatively high bit rate stereo case with a bit rate of 76 kb/s. In this case, the high bit rate scale factor band table 210 has been used to determine the master scale factor band table. Again, the upper diagram 320 shows the master scale factor band table which has been derived using the static scale factor band table 210, whereas the lower diagram 330 shows the master scale factor band table which has been derived using the algorithmic approach. The lines 321, 331 represent the borders of the scale factor bands of the respective master scale factor band tables. The lower diamonds 322, 332 represent the borders of the high resolution scale factor bands and the higher diamonds 323, 333 represent the borders of the low resolution scale factor bands. Again, it can be seen that the master scale factor band tables which are derived using the static, pre-determined scale factor band tables 200, 210 are substantially the same as the master scale factor band tables which are derived using the algorithmic approach.

In the example of FIG. 3*b*, the xOverBand parameter has been set to a value unequal to zero. In particular, the xOverBand parameter has been set to 2 for the algorithmic approach, while the xOverBand parameter has been set to 1 for the approach which has been described in the present document. As a result of using the xOverBand parameter, a number of frequency bands 324, 334, which is equal to the xOverBand parameter is excluded from the high resolution tables and the low resolution tables.

The current master scale factor band table (also referred to as the current master table) may be derived by the audio decoder using the pseudo code listed in Table 3.

TABLE 3

```
if( masterReset == 1 )
{
    If( masterScale == 1 )
    {
        nMfb = 22 - 2 * startFreq - 2 * stopFreq;
        For k = 0 to nMfb
            masterBandTable(k) = sfbTableHigh(2 * startFreq + k);
    }
    Else
    {
        nMfb = 20 - 2 * startFreq - 2 * stopFreq;
        For k = 0 to nMfb
            masterBandTable(k) = sfbTableLow(2 * startFreq + k);
    }
}
```

In the pseudo code of Table 3, the parameter masterReset is set to 1 if any of the following parameters has changed from the previous frame: the masterScale parameter, the startFreq parameter and/or the stopFreq parameter. As such, the reception of a changed masterScale parameter, startFreq parameter and/or stopFreq parameter triggers the determination of a new master table at the audio decoder. A current master table is used as long as a new (updated) master table is determined (subject to a changed master scale, start frequency and/or stop frequency parameter).

In the pseudo code of Table 3, masterBandTable is the derived master scale factor band table and nMfb is the number of scale factor bands in the derived master scale factor band table. From the derived master scale factor band table all other tables which are used in the HFR process, e.g. the high and low resolution frequency band tables, the noise band table and the limiter band table, may be derived according to legacy SBR methods which are specified e.g. in "ISO/IEC 14496-3 Information Technology—Coding of audio-visual objects—Part 3: Audio", which is incorporated by reference.

FIG. 4 shows a flow chart of an example method 400 for determining a master scale factor band table for a highband signal 105, 115 of an audio signal. In other words, the method 400 is directed at determining a master scale factor band table (also referred to as the master table) which is used in the context of an HFR scheme to generate the highband signal 105, 115 from a lowband signal 101, 111 of the audio signal. The master scale factor band table is indicative of a frequency resolution of a spectral envelope of the highband signal 105, 115. The method 400 comprises the step of receiving 401 a set of parameters, e.g. the start frequency parameter, the stop frequency parameter and/or the master scale parameter. Furthermore, the method 400 comprises the step of providing 402 a pre-determined scale factor band table 200, 210. In addition, the method 400 comprises the step of determining 403 the master scale factor band table by selecting some or all of the scale factor bands 130 of the pre-determined scale factor band table 200, 210, using the set of parameters.

In the present document, an efficient scheme for deriving the scale factor bands used for HFR is described. The scheme employs one or more pre-determined scale factor band tables from which the master scale factor band tables for HFR (e.g. for SBR) are derived. For this purpose, a set of parameters is inserted into the bitstream which is transmitted from the audio encoder to the audio decoder, thereby enabling the audio decoder to determine the master scale factor band table. The determination of the master scale factor band table only consists in table look-up operations, thereby providing a computationally efficient scheme for determining the master scale factor band table. In addition, the set of parameters which is inserted into the bitstream can be encoded in a bit rate efficient manner.

The methods and systems described in the present document may be implemented as software, firmware and/or hardware. Certain components may e.g. be implemented as software running on a digital signal processor or microprocessor. Other components may e.g. be implemented as hardware and or as application specific integrated circuits. The signals encountered in the described methods and systems may be stored on media such as random access memory or optical storage media. They may be transferred via networks, such as radio networks, satellite networks, wireless networks or wired networks, e.g. the Internet. Typical devices making use of the methods and systems described in the present document are portable electronic devices or other consumer equipment which are used to store and/or render audio signals.

The invention claimed is:

1. A system configured to determine a master scale factor band table of a highband signal of an audio signal, wherein the master scale factor band table is indicative of a frequency resolution of a spectral envelope of the highband signal; wherein the system is configured to:

receive a set of parameters transmitted from an audio encoder along with an audio bitstream being indicative of a lowband signal of the audio signal, the set of parameters including a selection parameter and one or more index parameters;

store a plurality of pre-determined scale factor band tables in a memory of the system independently from the audio encoder; wherein at least one scale factor band of the pre-determined scale factor band tables comprises a plurality of frequency bands;

determine the master scale factor band table by selecting a particular one of the pre-determined scale factor band tables based on the selection parameter of the received set of parameters and by selecting some or all of the scale factor bands of the selected pre-determined scale factor band table using the one or more index parameters of the received set of parameters, the one or more index parameters representing indexes into the selected pre-determined scale factor band table; and reconstruct the highband signal from the lowband signal using the master scale factor band table.

2. The system of claim 1, wherein the master scale factor band table is determined by truncating the selected pre-determined scale factor band table using the set of parameters.

3. The system of claim 1, wherein the master scale factor band table comprises only scale factor bands from the selected pre-determined scale factor band table.

4. The system of claim 1, wherein the one or more index parameters of the set of parameters comprise a start frequency parameter indicative of a scale factor band of the master scale factor band table having the lowest frequency of the scale factor bands of the master scale factor band table; and the system is configured to remove zero, one or more scale factor bands at a lower frequency end of the selected pre-determined scale factor band table for determining the master scale factor band table.

5. The system of claim 4, wherein the start frequency parameter comprises a 3 bit value taking on values between 0 and 7.

6. The system of claim 4, wherein the system is configured to remove an even number of scale factor bands at the lower frequency end of the selected pre-determined scale factor band table; and the even number is twice the start frequency parameter.

7. The system of claim 1, wherein the one or more index parameters of the set of parameters comprise a stop frequency parameter indicative of the scale factor band of the master scale factor band table having the highest frequency of the scale factor bands of the master scale factor band table; and the system is configured to remove zero, one or more scale factor bands at an upper frequency end of the selected pre-determined scale factor band table for determining the master scale factor band table.

8. The system of claim 7, wherein the stop frequency parameter comprises a 2 bit value taking on values between 0 and 3.

9. The system of claim 7, wherein the system is configured to remove an even number of scale factor bands at the upper frequency end of the selected pre-determined scale factor band table; and the even number is twice the stop frequency parameter.

10. The system of claim 1, wherein the selection parameter is a master scale parameter indicative of one of the plurality of pre-determined scale factor band tables, which is to be used to determine the master scale factor band table.

11. The system of claim 10, wherein the plurality of pre-determined scale factor band tables comprises a low bit rate scale factor band table and a high bit rate scale factor band table; and the low bit rate scale factor band table comprises one or more scale factor bands at lower frequencies than frequencies of any of the scale factor bands of the high bit rate scale factor band table; and/or the high bit rate scale factor band table comprises one or more scale factor bands at higher frequencies than frequencies of any of the scale factor bands of the low bit rate scale factor band table.

12. The system of claim 11, wherein the master scale parameter comprises a 1 bit value taking on values between 0 and 1, to distinguish between the low bit rate scale factor band table and the high bit rate scale factor band table.

13. The system of claim 11, wherein the low bit rate scale factor band table comprises one or more scale factor bands ranging from a first low frequency band to a first high frequency band; and the high bit rate scale factor band table comprises one or more scale factor bands ranging from a second low frequency band to a second high frequency band; and the first low frequency band is at a lower frequency than the second low frequency band; and/or the second high frequency band is at a higher frequency than the first high frequency band.

14. The system of claim 13, wherein a number of scale factor bands comprised within the high bit rate scale factor band table is higher than a number of scale factor bands comprised within the low bit rate scale factor band table.

15. The system of claim 13, wherein the frequency bands correspond to frequency bands generated by a 64 channel filter bank; and wherein the frequency bands range from band index 0 to band index 63.

16. The system of claim 15, wherein the low bit rate scale factor band table comprises some or all of the following scale factor bands from frequency band 10 up to frequency band 20, each scale factor band comprising a single frequency band;

scale factor bands from frequency band 20 up to frequency band 32, each scale factor band comprising two frequency bands;

scale factor bands from frequency band 32 up to frequency band 38, each scale factor band comprising three frequency bands; and/or scale factor bands from frequency band 38 up to frequency band 46, each scale factor band comprising four frequency bands.

17. The system of claim 16, wherein the high bit rate scale factor band table comprises some or all of the following scale factor bands from frequency band 18 up to frequency band 24, each scale factor band comprising a single frequency band;

scale factor bands from frequency band 24 up to frequency band 44, each scale factor band comprising two frequency bands; and/or scale factor bands from frequency band 44 up to frequency band 62, each scale factor band comprising three frequency bands.

18. The system of claim 1, wherein a number of frequency bands comprised within the scale factor bands of the selected pre-determined scale factor band table increases with increasing frequency.

19. The system of claim 1, wherein a number of scale factor bands comprised within the selected pre-determined scale factor band table and/or a number of scale factor bands comprised within the master scale factor band table is an even number.

20. The system of claim 1, further configured to determine a high resolution frequency band table and a low resolution frequency band table based on the master scale factor band table.

21. The system of claim 20, wherein the set of parameters comprises a cross over band parameter indicative of zero, one or more scale factor bands at a lower frequency end of the master scale factor band table, which are to be excluded from high frequency reconstruction; and the system is configured to determine the high resolution frequency band table and the low resolution frequency band table from the master scale factor band table by excluding the zero, one or more scale factor bands at the lower frequency end of the master scale factor band table in accordance to the cross over band parameter.

22. The system of claim 21, wherein the cross over band parameter comprises a 2 or 3 bit value taking on values between 0 and 3 or 7, to indicate the 0 up to 3 or 7 scale factor bands at the lower frequency end of the master scale factor band table, which are to be excluded.

23. The system of claim 21, wherein the high resolution frequency band table corresponds to the master scale factor band table without the zero, one or more scale factor bands at the lower frequency end of the master scale factor band table.

24. The system of claim 21, further configured to determine the low resolution frequency band table by decimating the high resolution frequency band table.

25. The system of claim 1, wherein the frequency bands correspond to frequency bands generated by a quadrature mirror filter bank.

26. The system of claim 1, wherein the lowband signal and the highband signal are segmented into a sequence of frames comprising a pre-determined number of samples of the audio signal;

the system is configured to receive an updated set of parameters for a set of frames from the sequence of frames;

the system is configured to maintain the master scale factor band table unchanged, if the parameters of the updated set of parameters, which affect the master scale factor band table, remain unchanged; and the system is configured to determine an updated master scale factor band table, if the parameters of the updated set of parameters, which affect the master scale factor band table, change.

27. The system of claim 26, wherein the system is configured to receive an updated set of parameters for each frame of the sequence of frames.

28. The system of claim 26, further configured to determine a noise band table and/or a limiter band table and/or a patching scheme for transposition from the master scale factor band table and/or from the high and low resolution frequency band tables.

29. A method for determining a master scale factor band table for a highband signal of an audio signal, wherein the master scale factor band table is indicative of a frequency resolution of a spectral envelope of the highband signal; wherein the method comprises:

receiving a set of parameters transmitted from an audio encoder along with an audio bitstream being indicative of the lowband signal of the audio signal, the set of parameters including a selection parameter and one or more index parameters;

storing a plurality of pre-determined scale factor band tables in a memory independently from the audio encoder; wherein at least one scale factor band of the pre-determined scale factor band tables comprises a plurality of frequency bands;

determining the master scale factor band table by selecting a particular one of the pre-determined scale factor band tables based on the selection parameter of the received set of parameters and by selecting some or all of the scale factor bands of the selected pre-determined scale factor band table using the one or more index parameters of the set of parameters, the one or more index parameters representing indexes into the selected pre-determined scale factor band table; and reconstructing the highband signal from the lowband signal using the master scale factor band table.

* * * * *